US012692771B2

(12) United States Patent
Willberg

(10) Patent No.: US 12,692,771 B2
(45) Date of Patent: Jul. 28, 2026

(54) METHOD AND SYSTEM TO CREATE A TORTUOUS FLOW PATH

(71) Applicant: Schlumberger Technology Corporation, Sugar Land, TX (US)

(72) Inventor: Dean Michael Willberg, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/027,258

(22) Filed: Jan. 17, 2025

(65) Prior Publication Data

US 2026/0210217 A1 Jul. 23, 2026

(51) Int. Cl.

| | |
|---|---|
| ***E21B 43/12*** | (2006.01) |
| ***E21B 43/17*** | (2006.01) |
| ***E21B 43/20*** | (2006.01) |
| ***E21B 43/28*** | (2006.01) |

(52) U.S. Cl.

CPC ..... *E21B 43/12* (2013.01); *E21B 43/17* (2013.01); *E21B 43/20* (2013.01); *E21B 43/283* (2013.01)

(58) Field of Classification Search

CPC ..... E21B 43/12; E21B 43/17; E21B 43/20; E21B 43/283

See application file for complete search history.

(56) References Cited

U.S. PATENT DOCUMENTS

| | | | | |
|---|---|---|---|---|
| 3,004,600 | A | 10/1961 | Henderson | |
| 3,537,529 | A | 11/1970 | Timmerman | |
| 5,030,036 | A | 7/1991 | Huff | |
| 5,377,756 | A | 1/1995 | Northrop | |
| 8,657,005 | B2 * | 2/2014 | Entchev | E21B 43/16 166/305.1 |
| 9,803,456 | B2 | 10/2017 | Kerr | |
| 9,828,840 | B2 | 11/2017 | Dawson | |
| 11,708,750 | B2 * | 7/2023 | AlYousif | E21B 43/164 166/402 |
| 11,959,356 | B2 | 4/2024 | Toews | |
| 2011/0265994 | A1 * | 11/2011 | Entchev | C09K 8/508 166/270 |
| 2011/0277996 | A1 * | 11/2011 | Cullick | E21B 43/16 166/250.12 |
| 2013/0292114 | A1 | 11/2013 | Lin | |
| 2014/0096954 | A1 * | 4/2014 | Hocking | E21B 43/267 166/248 |
| 2018/0171768 | A1 * | 6/2018 | Tiffany, III | C02F 9/00 |
| 2019/0195043 | A1 | 6/2019 | Singh | |
| 2019/0249527 | A1 | 8/2019 | Kraynek | |
| 2022/0074294 | A1 | 3/2022 | Usoltsev | |
| 2022/0154562 | A1 * | 5/2022 | AlYousif | E21B 33/134 |

FOREIGN PATENT DOCUMENTS

| | | | | |
|---|---|---|---|---|
| WO | WO-2023227526 | A1 * | 11/2023 | C22B 26/12 |
| WO | 2024064303 | A1 | 3/2024 | |

* cited by examiner

*Primary Examiner* — Tara Schimpf

*Assistant Examiner* — Daniel T Craig

(74) *Attorney, Agent, or Firm* — Jeffrey D. Frantz

(57) ABSTRACT

A system for creating a tortuous flow path is disclosed. The system includes a production zone, and a man-made impermeable barrier disposed along a fluid flow path to the production zone to create tortuous flow path for a fluid flowing between the injection zone and the production zone.

18 Claims, 11 Drawing Sheets

METHOD AND SYSTEM TO CREATE A TORTUOUS FLOW PATH

BACKGROUND OF THE DISCLOSURE

In-situ mining is the process of extracting minerals from an underground deposit while the deposit remains underground, often without mass excavation of the ore and surrounding formation. Typically, in-situ mining involves both the production of a solution or brine from the formation from production wells, and the injection (or re-injection) of water, solution or brines into the formation through injection wells. The combination of production and injection may be considered a full cycle process. The injection half of the cycle is advantageous, and in most cases necessary, for the following three reasons. First, injection of fluids into the formation maintains a mass and volumetric balance in the pore space of the formation. Doing so it maintains the hydrostatic pressure in the formation which is necessary to avoid collapse of the formation and surface subsidence. Second, the large volume of the spent brines from the mineral extraction process need to be disposed of. Usually this spent brine is not potable, and cannot be disposed of at the surface. Reinjection of the spent brines back into their original formation is usually the most logical, cost effective and environmentally sound means of disposal. Third, water or depleted brine reinjected into the formation may dissolve and sweep out addition target mineral.

SUMMARY

In some aspects, the techniques described herein relate to a system for creating a tortuous fluid flow path. The system includes a production well, an injection well remotely spaced from the production well, and a man-made impermeable barrier disposed between the injection well and the production well to create tortuous flow path for a fluid flowing between the injection well and the production well.

In some aspects, the techniques described herein relate to a method of creating a tortuous flow path from an injection zone to a production zone. The method includes hydraulicly fracturing a formation along a previously existing fluid flow path. The method further includes injecting barrier material into the formation to form a man-made impermeable barrier and changing the previously existing fluid flow path to the production zone with the man-made impermeable barrier to create the tortuous flow path. In an embodiment, the injection zone is in an injection well and the production zone is in a production well spaced apart from the injection zone, wherein the method further includes selecting or drilling a wellbore in or near the previously existing fluid flow paths and hydraulicly fracturing and injecting the barrier material using the selected or drilled wellbore. In another embodiment, the injection zone and the production zone are located in the same wellbore.

In some aspects, the techniques described herein relate to a system implementing a tortuous flow path. The system includes a wellbore including at least one of an injection zone, a production zone, and a man-made impermeable barrier extending from the wellbore adjacent the at least one of the injection zone and the production zone. A fluid follows the tortuous flow path and makes at least a 5 degree change in flow direction proximate the man-made impermeable barrier.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 1-2 is a schematic diagram of a side view of a wellbore used to form man-made impermeable barriers in between the injection well and the production well, according to at least one embodiment of the present disclosure;

FIG. 1-3 is a schematic diagram of a side view of an injection well injecting fluid that interacts with the man-made impermeable barriers and is produced by a production well, according to at least one embodiment of the present disclosure;

FIG. 2-1 is a schematic diagram of a side view of a wellbore used to form man-made impermeable barriers in between the injection well and the production well, according to at least one embodiment of the present disclosure;

FIG. 2-2 is a schematic diagram of a side view of an injection well injecting fluid that interacts with the man-made impermeable barriers and is produced by a production well, according to at least one embodiment of the present disclosure;

FIG. 3-1 is a schematic diagram of a top view of an injection well injecting fluid underground that is collected and produced by a production well, according to at least one embodiment of the present disclosure;

FIG. 3-2 is a schematic diagram of a top view of wellbores used to form man-made impermeable barriers in between the injection well and the production well, according to at least one embodiment of the present disclosure;

FIG. 3-3 is a schematic diagram of a top view of an injection well injecting fluid that interacts with the man-made impermeable barriers and is produced by a production well, according to at least one embodiment of the present disclosure;

DETAILED DESCRIPTION

Figure 1:
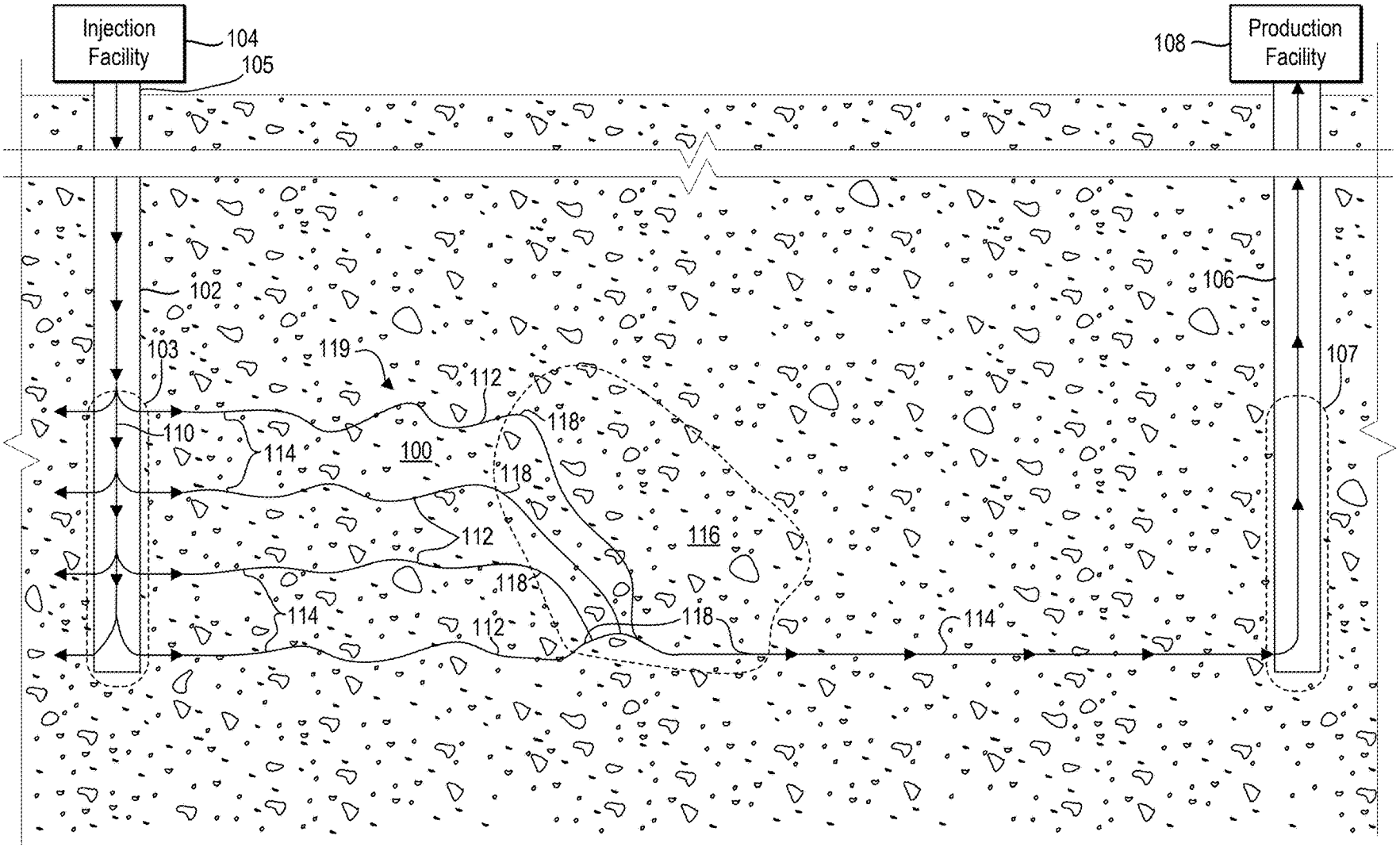
FIG. 1-1 is a schematic diagram of a side view of an injection well injecting fluid underground that is collected and produced by a production well, according to at least one embodiment of the present disclosure.

This disclosure generally relates to devices, systems, and methods for creation of a tortuous flow path for a fluid (such as a brine) to flow as it moves toward a production zone of a well. In one aspect, hydraulically formed fractures in a formation are filled with a barrier material to form a man-made impermeable (or low permeability) barrier. Man-made impermeable barriers are placed to alter the flow path of the fluid as it moves through a formation toward the production zone of a well. Depending on the stresses in a formation, the man-made impermeable barriers may be horizontally or vertically oriented.

The placement and design of injection wells, production wells, monitoring wells, and man-made impermeable barriers may be engineered and placed based on knowledge of the formation to be mined to improve the existing flow paths that the injected fluid follows before installation of the injection wells, production wells, monitoring wells, and man-made impermeable barriers. Further, the man-made impermeable barriers may be engineered and placed before the injection of fluid into a formation so that the likely flow paths through the formation may be improved to slow and widen the movement of the injected fluid through the formation.

As a consequence, the improved production offered by the system and method disclosed in this application may extend or remediate the life of existing wells and/or improve the recovery rate of desired minerals and/or desired substances at a production well. These improvements may increase the chances of financial success for a well, as well as make the desired minerals and substances available for use in society.

The placement of wells and the man-made impermeable barriers may be based on seismic, micro-seismic, well-logging, and other data gathering methods about the formation. In some cases, geologic maps may be helpful in understanding the stresses in the formations to be accessed. The placement of the man-made impermeable barriers may also be based on the experience of the personnel digging the wells and the sensors in the equipment being used such as tilt meters on the surface or in adjacent wellbores, or pressures being seen during hydraulic fracturing may assist fracturing engineers to develop a better understanding of the stresses in a formation. Common practice is to execute small fracturing treatments prior to the main fracturing event. Fracturing occurs when injection pressures are above the fracturing gradient of the formation. The pressures and flowrates of these small fracturing treatments, and their subsequent behavior flowing the release of pressure can be interpreted to understand the stresses that exist in the formation. The quality of the information obtained can be improved by the use of bottomhole pressure gauges. Other methods of measuring stress involve measuring the deformation of the wellbore after drilling using a caliper gauge, or executing a microfracture with an MDT tool positioned between two straddle packers.

By knowing the stresses, the total number of injector wells versus production wells may be minimized. Further, man-made impermeable barriers may be placed into the formation to increase the tortuosity of the flow between the between the injection well and production wells to increase the sweep efficiency and potentially further reduce the needed number of injector and production wells needed to produce from a formation. The techniques disclosed herein may also assist in preventing or remediating thief zones where injected fluid may be lost into surrounding formations.

As used herein, the term "tortuous flow path" refers to a fluid flow path that is affected by a man-made impermeable barrier. For example, a previously existing fluid flow path is affected or changed by its proximity to a man-made impermeable barrier so that the fluid moves in a new flow path or at different flow rates through an existing flow path. For example, pre-existing fluid flow paths through a formation from an injection zone to a production zone may move through a wide area in a low porosity region and transition into a high porosity region where the pre-existing fluid flow paths narrow to flow through a narrow area of high porosity region. A man-made impermeable barrier may be created and extend through the high porosity region into the low porosity region to direct the fluid flow paths along a wider flow path and prevent a portion of the pre-existing fluid flow paths from narrowing as much in the high porosity region as before the man-made impermeable barrier had been created. Alternatively, a man-made impermeable barrier may be created to redirect the fluid around the high porosity region along a new flow path.

As used herein, the term "impermeable" refers to a material that has a lower permeability than the permeability of a surrounding formation. For example, a man-made impermeable barrier made of Portland Cement has a lower permeability than a limestone formation surrounding it. Further, permeability may vary across a man-made impermeable barrier.

As used herein, the term "formation" refers to any finite subsurface region. As used herein, the term "hydraulic fracture" refers to a fracture at least partially propagated into a formation, wherein the fracture is created through injection of pressurized fluids or slurries into the formation. Hydraulic fractures may be substantially horizontal in orientation, substantially vertical in orientation, oriented along any other plane depending on the stresses within the formation, or highly complex with many branches, both vertical and horizontal in orientation as the result of complex interactions between the overall stress field and formation texture and composition.

As used herein, the term "wellbore" refers to a hole in the subsurface made by drilling or insertion of a conduit into the subsurface. A wellbore may have a substantially circular cross section, or other cross-sectional shapes (e.g., circles, ovals, squares, rectangles, triangles, slits, or other regular or irregular shapes). As used herein, the term "well," when referring to an opening in the formation, may be used interchangeably with the term "wellbore." The wellbore can be predominantly vertical with respect to a plane that represents the local surface of the earth. It can be deviated from vertical, and it can be directionally drilled (i.e. starts vertical, but is directed during the drilling process into a horizontal orientation.

FIG. 1-1 is schematic diagram of a side view of an injection well 102 and a production well 106, according to at least one embodiment of the present disclosure. As shown, the injection well 102 is remotely spaced or positioned from the production well 106. While only a single injection well 102 and a single production well 106 is shown, a plurality of injection wells and/or a plurality of production wells may be used. The production well 106 may collect or receive fluid from the formation. For example, the formation may include a brine that is rich in a desired substance. The production well 106 may pump the brine out of the formation for concentration and/or processing of the desired substance. As a specific, non-limiting example, the brine may be rich in lithium, and the production well 106 may pump the lithium-rich brine out of the formation for further concentration and/or processing.

In some embodiments, the production well 106 may pump the brine rich in the desired substance out of the formation without pumping any fluid into the formation at the injection well 102.

In some embodiments, as discussed in further detail herein, the injection well 102 may pump fluid into the formation to replace the fluid pumped out by the production well 106. For example, the injection well 102 may pump depleted brine (e.g., brine that has had the desired substance removed or largely removed) into the formation. This may help to maintain fluid flow through the formation and/or maintain pore pressure. This may further provide a storage location for the process water used during the processing of the desired substance. While embodiments of the present disclosure may discuss injecting a fluid into an injection well, it should be understood that the techniques of the present disclosure may be applied to pre-existing fluid flow through a formation or in-situ brines rich in the desired substance in the formation (e.g., without injection of a fluid through the injection well 102.

As a brine 110 moves into and through the formation 100, the brine 110 may follow a plurality of flow paths 112 through the formation 100 toward the production well 106. In some situations, the brine 110 may pass into a high porosity formation 116, and the brine 110 may follow low-resistance path 114. The low-resistance path 114 may cause the brine 110 to short-cut through the formation to the production well 106. This may result in less of the brine 110 in the formation collected at the production well, thereby reducing the yield of the mining system.

In some embodiments, the mining system may be a solution mining system, in which the brine 110 is injected into the formation to dissolve at least a portion of the formation. For example, as shown, the injection well 102 is connected to an injection facility 104. The injection facility 104 pumps a brine (e.g., an injection fluid) into the injection well 102 through an injection zone 103 to force the brine 110 into the formation 100 containing desired substances, such as the minerals lithium, manganese, copper, cobalt, nickel, vanadium, magnesium, boron, bromine, or any other soluble mineral salts, and substances, such as oil, natural gas, coalbed methane, shale oil, pyrolysis oil, pyrolysis gas, a pyrolysis product of coal, and other hydrocarbons that are in a gaseous or liquid state. The brine 110 may be water or solutions of water with other species. The water may be a "brine" that includes dissolved inorganic salts of chloride, sulfates and carbonates of Group I and II elements of The Periodic Table of Elements. Organic salts may also be in the brine 110. The brine 110 may be designed or configured to dissolve a particular desired substance as the fluid travels from the injection well 102 to the production well 106. The water may also include acids and bases to alter the pH of the brine 110. The water may also include soluble polymeric chemicals, or viscoelastic surfactants to modify its viscosity, thereby modifying viscous fingering at the injection fluid and formation frontier. The water may also contain surfactants to alter the wetting characteristics of mineral surfaces. Alternatively, the brine 110 may be a multiphase fluid. For example, the brine may contain both liquid and gas as in a foam, or it may contain both water and an immiscible organic liquid like a mineral oil. Multi-phase fluids can be deployed in a number of different fashions. For example, a water/gas system can be pumped as a highly stable foam. Alternatively, the water and gas phases may be pumped separately as alternating water/gas phases—relying on their relatively place in the formation 100, and their interactions within the pore-structure to deliver important benefits. Alternatively, the gas and water may be injected at different locations in the wellbore to help control the injection and displacement profile of the fluids. The brine 110 may also be comprised of a supercritical phase, such as supercritical CO2.

In some embodiments, when the brine 110 reaches a production zone 107 of the production well 106, the collection facility 108 pumps the brine up to the collection facility 108, where the brine 110 may be stored, transported, or processed to obtain the desired minerals or substance, such as lithium, manganese, copper, vanadium, nickel, cobalt, etc. from the brine 110. The processing may be accomplished by a variety of methods, including precipitation, solvent extraction, sorption, adsorption, desorption, membrane-based separation, and electrochemical-based separation. In some embodiments, the brine 110 may be processed to produce a depleted injected fluid and a concentrated injected fluid that may be further processed at another facility to obtain the desired minerals, substances, and elements. Depending on the process, the depleted injected fluid may be reinjected through the injection well 102 as brine 110, where the brine 110 flows back into the formation 100.

The injection well 102 may include a well casing 105 as well as other equipment (not shown). The injection facility 104 may include holding tanks (not shown) of brine 110, piping, pumps, and other equipment necessary to inject brine 110 through the injection well 102 into the formation 100. The injection zone 103 may include holes in the well casing or nozzles that allow the brine 110 to be injected into the formation 100. The injector well 102 may include hardware, including sensors, values, chokes, etc. that facilitate controlled injection of brine 110 into the formation 100.

As the brine 110 travels through the formation, the brine may at least partially dissolve minerals in the formation. The farther the brine 110 moves through the formation 100, the higher the concentration of desired minerals that may be dissolved into the brine 110. Thus, the more and wide spread the flow paths 112 of the brine 110 are, the more desired minerals may be dissolved into the brine 110 or more desired substances in the formation 100 may be moved toward the production well 106.

As shown, when the brine 110 reaches the high porosity formation 116, such as a thief zone, the brine 110 may flow along undesirable flow paths 118 bypassing much of the remaining formation 100. The high porosity formation 116 may allow the brine 110 to merge into fewer undesirable flow paths 118. Consequently, the sweep efficiency of the production well 106 may fall quickly while much of the desired minerals or desired substances remain in the formation 100.

As shown in FIG. 1-1, the flow paths 112 and undesirable flow paths 118 are collectively, previously existing flow paths 119. The previously existing flow paths 119 may be determined by the existing porosity, stresses, and geology of the formations 100 and 116.

Figures 1, 2:
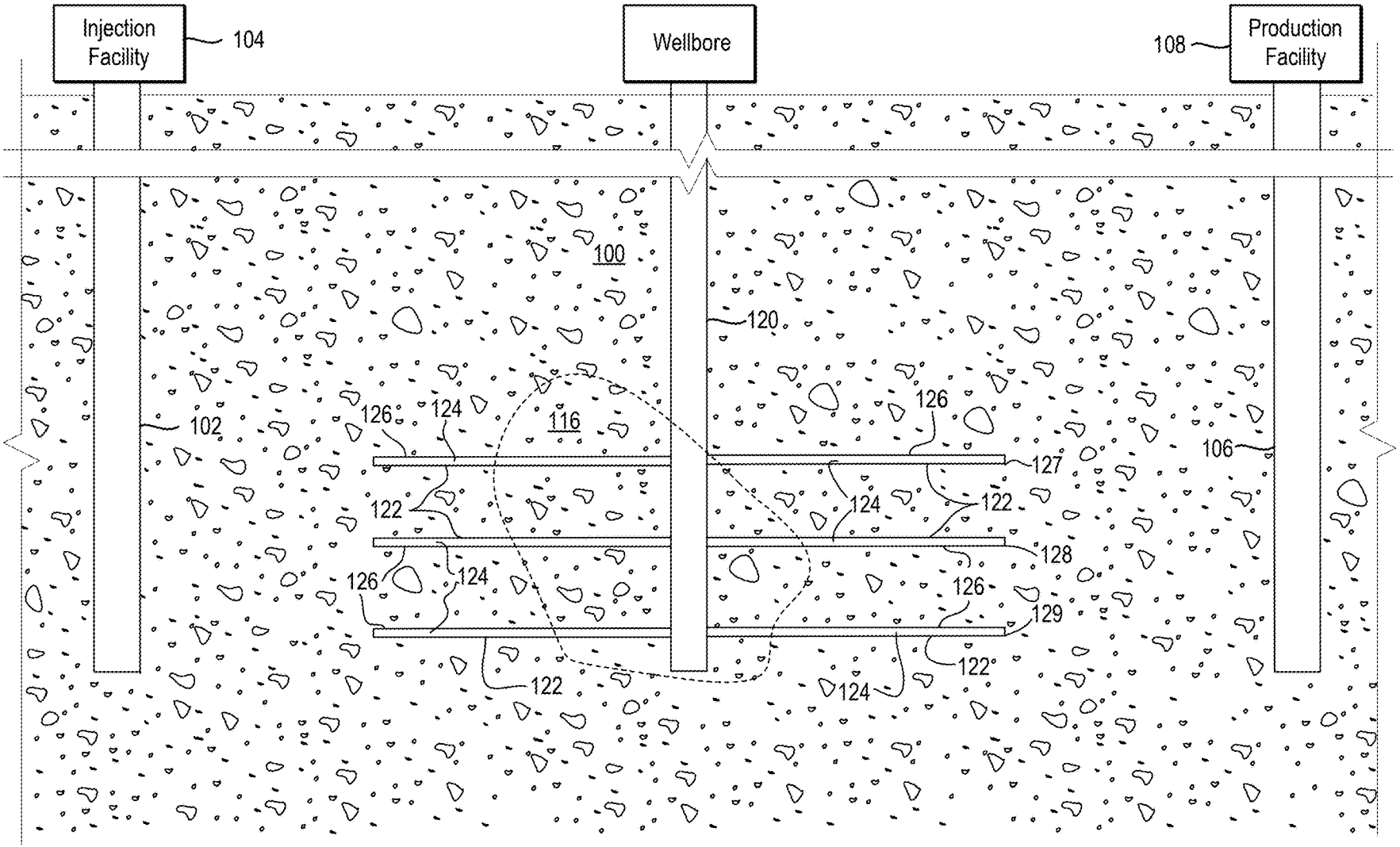

FIG. 1-2 is schematic diagram of a side view of the injection well 102 and the production well 106 of FIG. 1-1. For clarity of illustration, the flow paths 112 and the undesirable flow paths 118 are not shown.

A wellbore 120 may be drilled into the formation 100 and the high porosity formation 116. While only a single wellbore 120 is shown, a plurality of wellbores may be used to implement the systems and methods described in this application.

In this example, the stresses in the formation 100 and high porosity formation 116 likely promote the growth of generally horizontal fractures when hydraulicly fractured. The fractures 122 are created from the wellbore 120 by hydraulic fracturing and extend out from the wellbore 120 at desired locations. In FIG. 1-2, the fractures 122 are planes that extend perpendicularly to the page-both into and out of the page.

The fractures 122 are then filled with a barrier material 124 such as a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, a thermoset plastic, or a mixture of different materials. Barrier material 124 may be added to the hydraulic fluid as it is used to create the fracture. Then as the hydraulic pressure is released, the fractures 122 close around the barrier material 124 to form man-made impermeable barriers 126. As shown, the man-made impermeable barriers 126 extend across the high porosity formation 116, and thus, should alter the flow paths 112.

Once the man-made impermeable barriers 126 are formed, the wellbore 120 may be filled in, or alternatively, used as an observation well to measure pressures, temperatures, collect chemical samples, inject tracer fluids, etc. The wellbore 120 may be filled in with barrier material 124 or material from the formation 100 and the high porosity formation 116. As the wellbore 120 is filled in, it may have barrier material 124 selectively added to fill in the hole in the man-made impermeable barriers 126 left by the wellbore 120 as shown in FIG. 1-3.

As shown in this example, the man-made impermeable barriers 126 comprise a first man-made impermeable barrier 127, a second man-made impermeable barrier 128, and a third man-made impermeable barrier 129. In some applications (not shown), only a first man-made impermeable barrier may be installed to alter the undesirable flow paths of the injected fluid into the tortuous flow paths. Alternatively, only a first man-made impermeable barrier and a second man-made impermeable barrier may be installed. In other applications, a plurality of wellbores and a plurality of man-made impermeable barriers may be constructed to alter the undesirable flow paths of the injected fluid into the tortuous flow paths.

The installation of the man-made impermeable barriers 126 by hydraulicly fracturing the formation 100 and the high porosity formation 116 may be relatively inexpensive, because the wellbore 120 does not require maintenance after installation of the man-made impermeable barriers 126 or any of the hardware associated with an injection well, production well, or monitoring wells.

Figures 1, 2, 3:
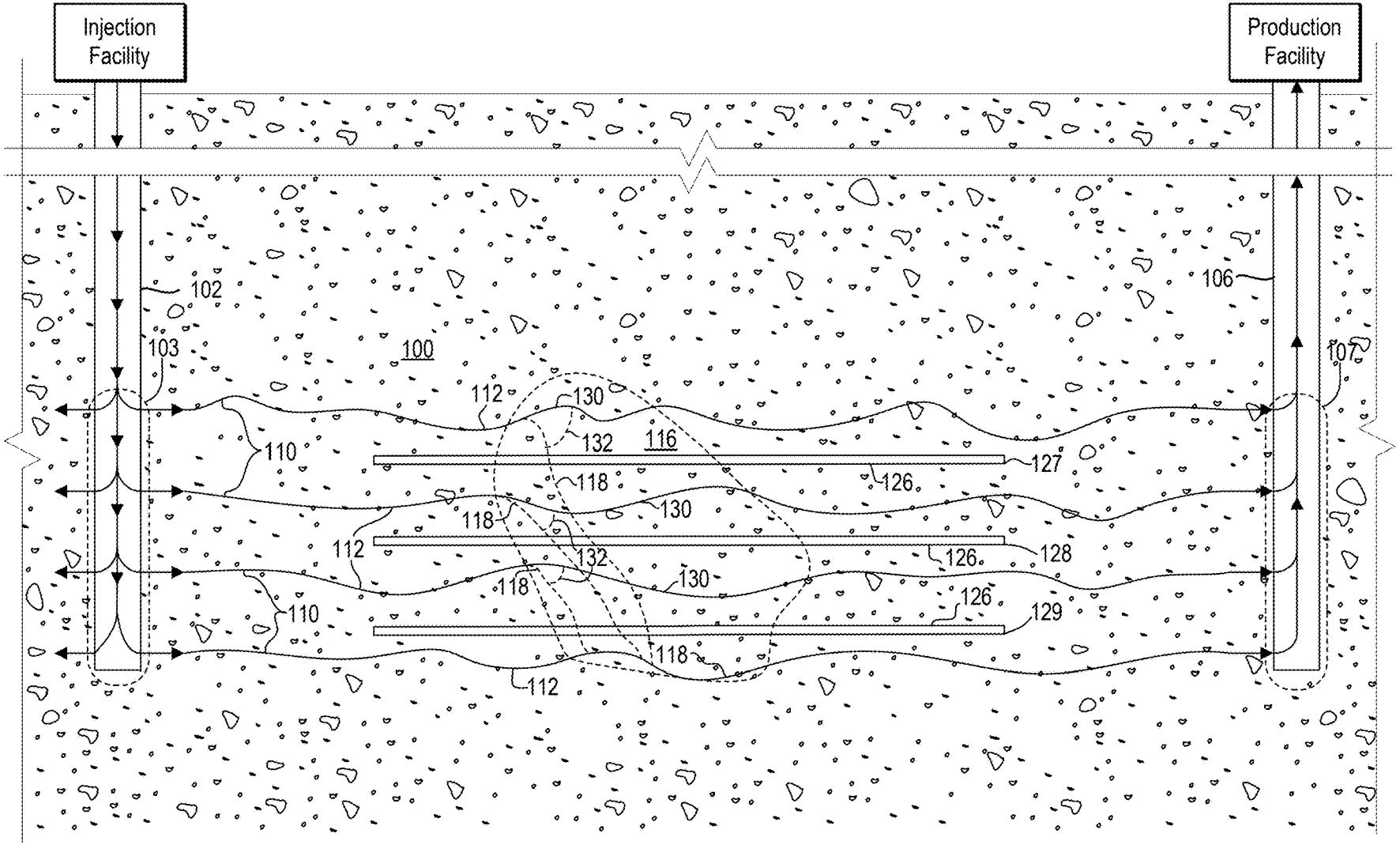
Figures 1, 2:
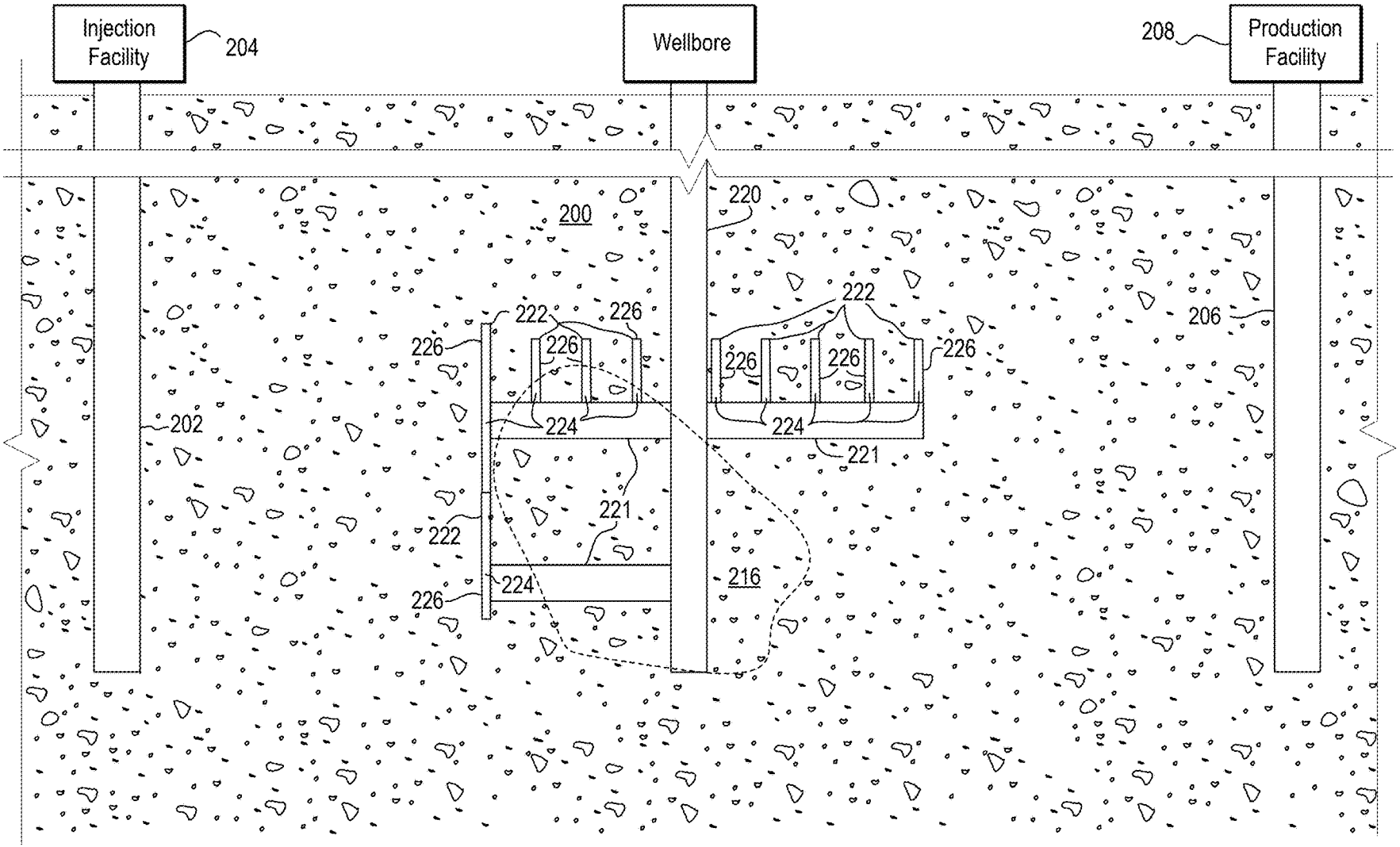
Figure 2:
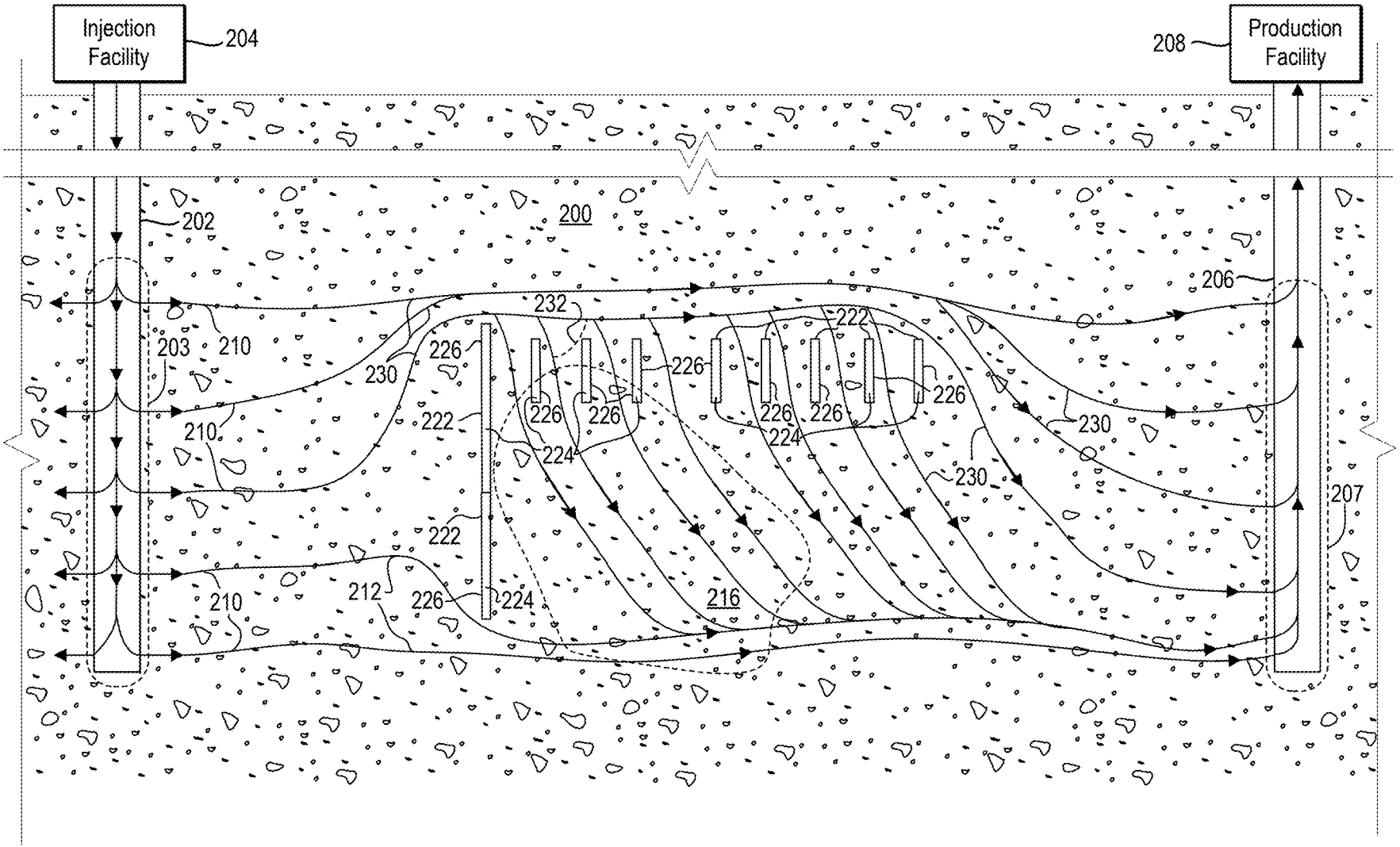
Figures 1, 3:
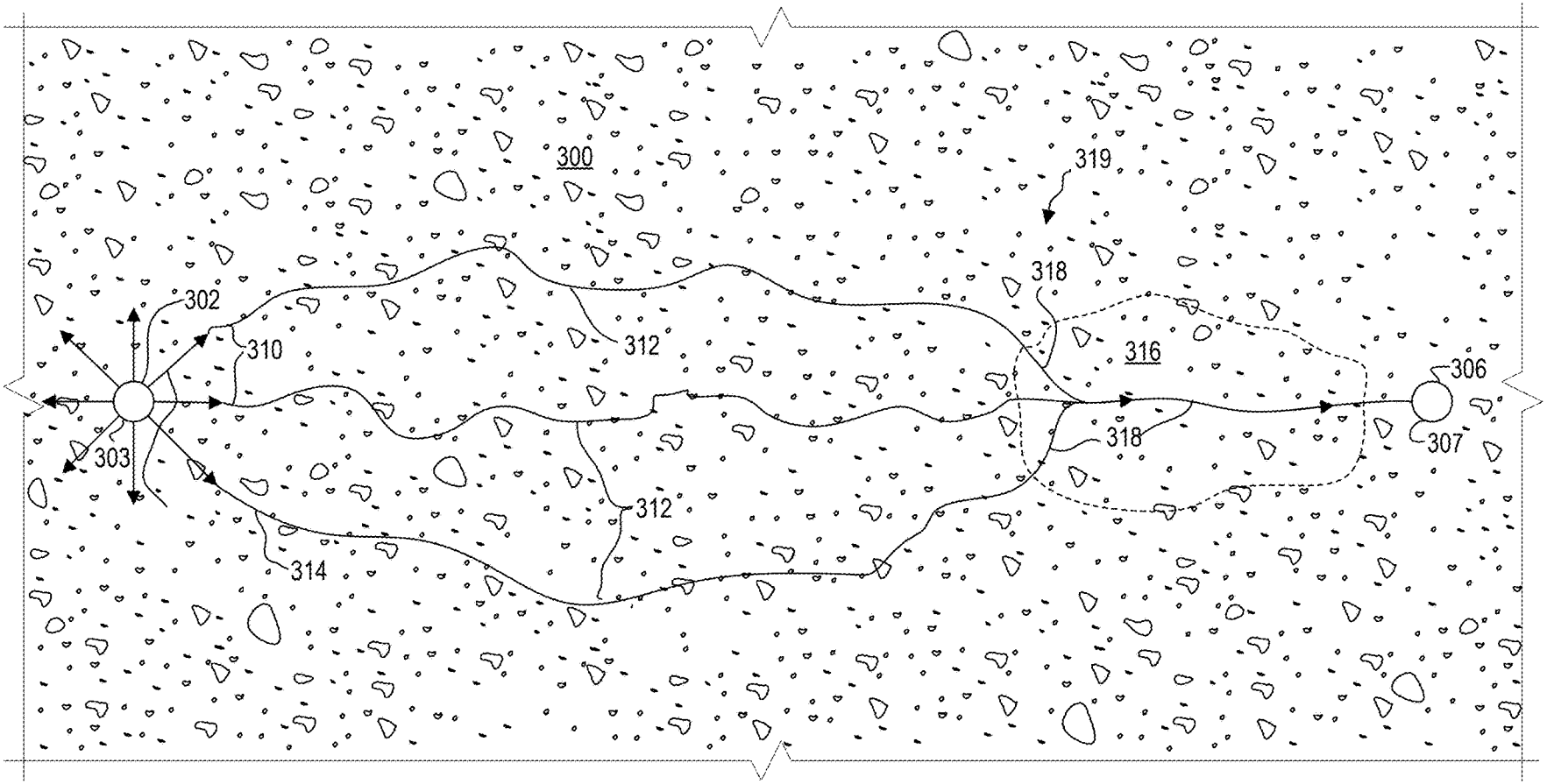
Figures 2, 3:
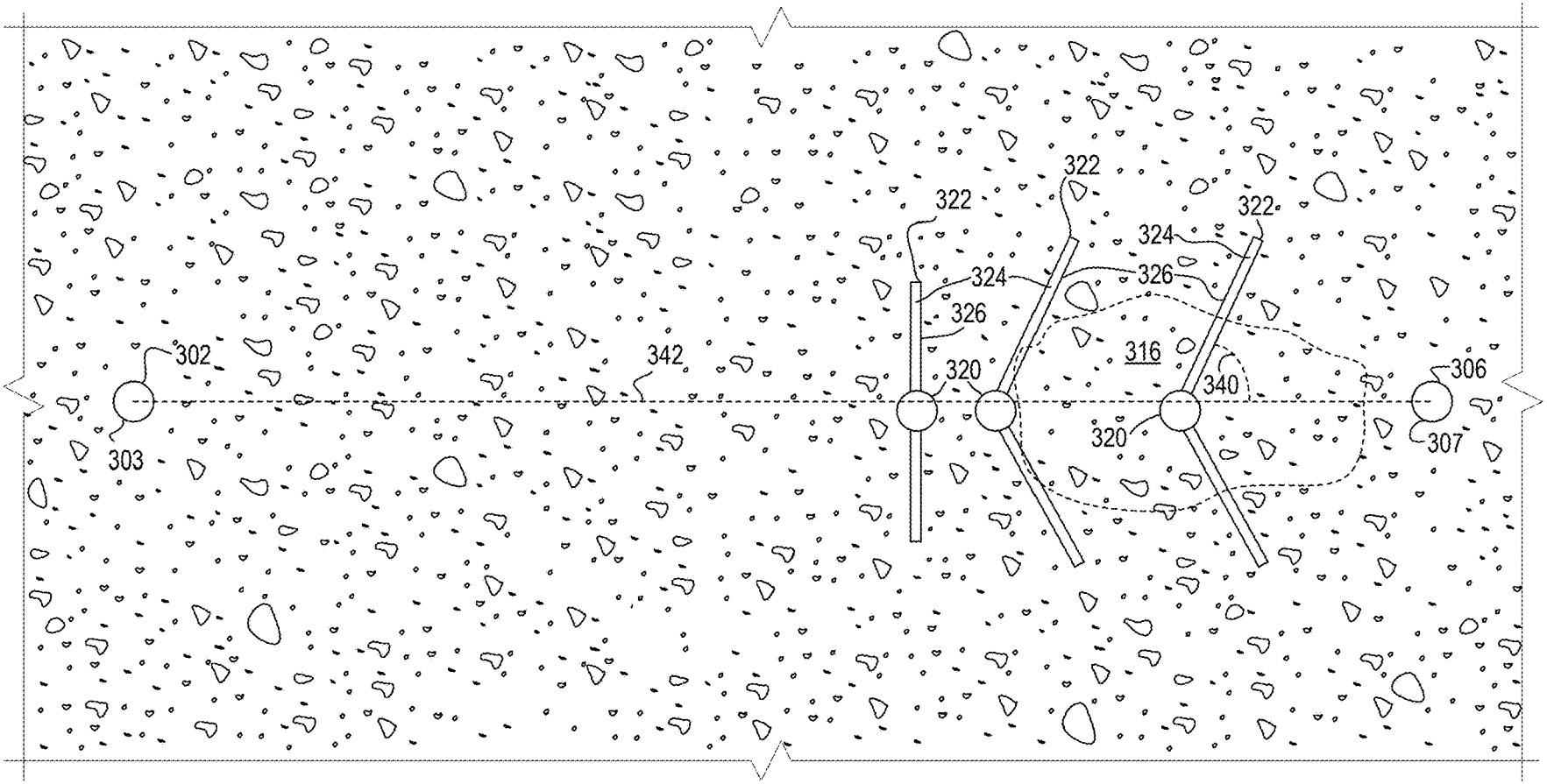
Figure 3:
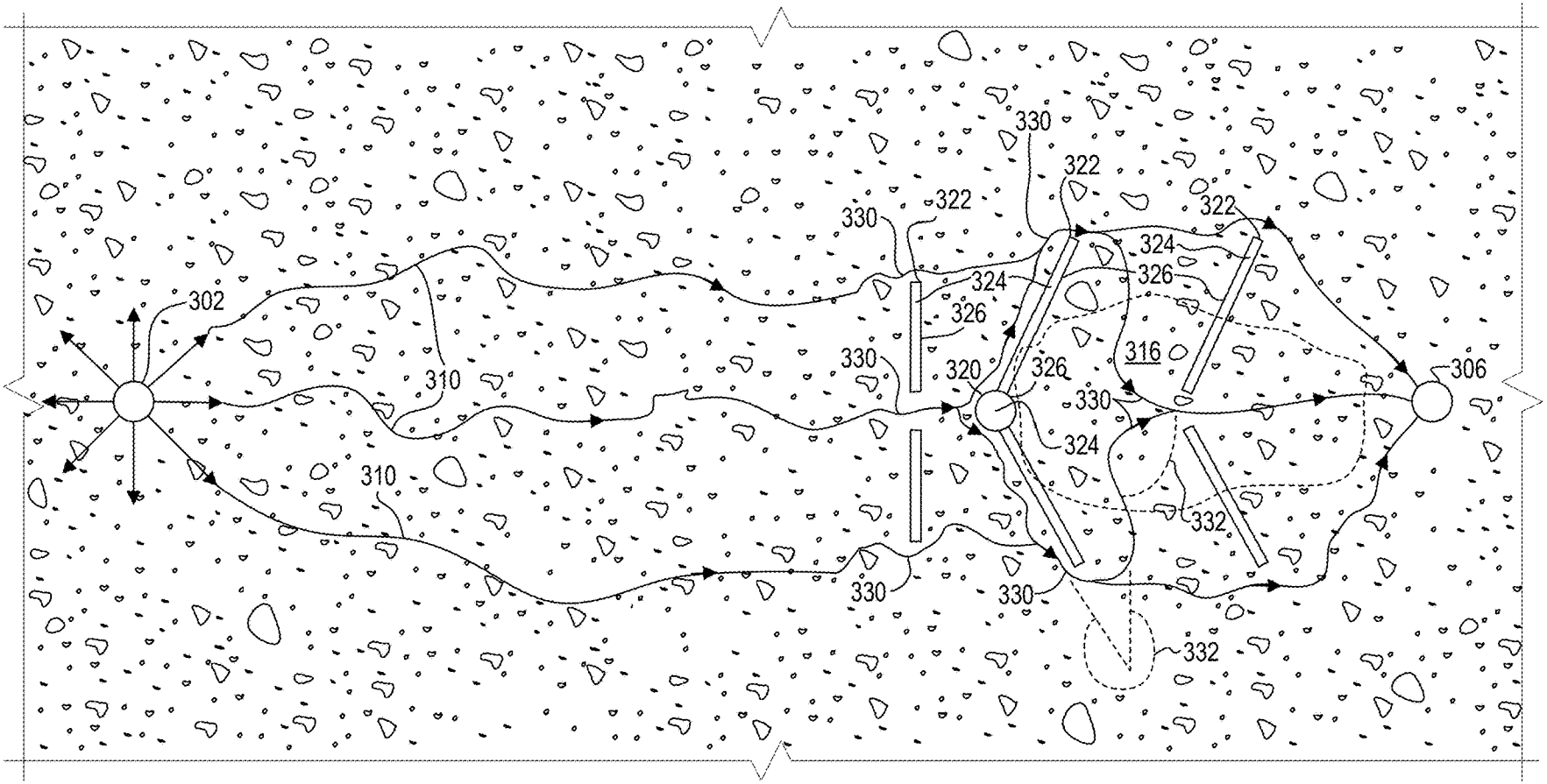

FIG. 1-3 is schematic diagram of a side view illustrating the effect of the man-made impermeable barriers 126 on the previously existing fluid flow paths 119 of flow paths 112 of the brine 110 through the formation 100 and the undesirable flow paths 118 through the high porosity formation 116 and the rest of the formation 100 as compared to FIG. 1-1. As discussed herein, in some embodiments, the injection facility 104 pumps the brine 110 into the injection well 102 through the injection zone 103 into the formation 100.

When the flow paths 112 of the brine 110 enter the high porosity formation 116, the flow paths 112 follow a tortuous flow path 130 that is an angle 132 from the undesirable flow paths 118 of the previously existing fluid flow paths 119 that the brine 110 followed in FIG. 1-1 before the installation of the man-made impermeable barriers 126.

As shown the first man-made impermeable barrier 127 alters the previously existing fluid flow path 119 by an angle 132 of about 75 degrees to the tortuous flow path 130. The second man-made impermeable barrier 128 alters the previously existing fluid flow path 119 (i.e. previously existing fluid flow path 119 shown within FIG. 1-1) by an angle 132 of about 35 degrees to the tortuous flow path 130, and a third man-made impermeable barrier 129 alters the previously existing fluid flow paths 119 by an angle 132 of about 25 degrees to the tortuous flow path 130. In some applications, the angle 132 may be greater than 5 degrees. In other applications, the angle 132 may be greater than 10 degrees. While in others, the angle 132 may be greater than 15 degrees or greater than 20 degrees.

Generally, the angle 132 may range from 5 degrees to as much as 180 degrees. In some applications, the angle 132 may range from 10 degrees to 160 degrees. In some applications, the angle 132 may range from 15 degrees to 145 degrees. In some applications, the angle 132 may range from 20 degrees to 135 degrees. In some applications, the angle 132 may range from 15 degrees to 90 degrees. In other applications, the angle 132 may range from 15 degrees to 75 degrees. In some applications, the angle 132 may be greater than 5 degrees but less than 90 degrees. The angle 132 will depend on the tortuous flow path 130 the brine 110 follows after the installation of the man-made impermeable barriers 126 when compared to a previously existing fluid flow path 119 starting from the same point of divergence.

As shown, the tortuous flow paths 130 follow new flow paths through the formation 100 allowing the brine 110 to dissolve the desired mineral salts from of the formation 100 that were previously untouched by the brine 110 and/or to delay breakthrough of the injected fluid into the production zone. In other words, the tortuous flow path 130 may divert through a part of the formation 100 that was not a part of the previously existing fluid flow path 119 and so covers a larger volume of the formation 100 than the previously existing fluid flow path 119. Consequently, the sweep efficiency may increase after installation of the man-made impermeable barriers 126.

In this application, the previously existing fluid flow paths 119 may be the same or longer than the tortuous flow paths 130. For example, the flow path 112 below the third man-made impermeable barrier 129 remains relatively unchanged and was not affected by the installation of the man-made impermeable barriers 126. In fact, the bottom most flow path 112 continues to follow the undesirable flow path 118 through the high porosity formation 116 and the formation 100 to the production zone 107 of the production well 106.

FIG. 2-1 is schematic diagram of a side view of a wellbore 220 used to form man-made impermeable barriers 226 in the formation 200 between the injection well 202 and the production well 206. Like FIG. 1-1, a high porosity formation 216 is also shown within the formation 200 that may affect the flow of a brine through the formation. Unlike FIG. 1-1, the stresses in the formation 100 encourage the formation of generally vertical fractures 222.

As shown, horizontal wellbores 221 have been drilled into the formation 200 and the high porosity formation 216. From the horizontal wellbores 221, the formation 200 and the high porosity formation 216 are hydraulically fractured to form fractures 222. The fractures 222 are filled with barrier material 224 and the hydraulic pressure is released allowing the fractures 222 to close around the barrier material to form the man-made impermeable barriers 226.

The placement of the man-made impermeable barriers 226 may be based on seismic, magnetic resonance imaging, and other data gathering methods about the formation 200. The placement of the man-made impermeable barriers 226 may also be based on the experience of the well drillers. For example, the wellbore 220 may be a test well in which the high porosity formation 216 is discovered. To determine the boundaries of the high porosity formation 216, horizontal wellbores 221 may be drilled. Consequently, this information about the formation 200 and the high porosity formation 216 may allow a tortuous flow path to be designed to alter potential flow paths of brine through the formation based on the estimated stresses within the formation 200 and the high porosity formation 216, the geology of the formation 200 and the high porosity formation 216, and the potential flow paths of the brine through formation 200 and the high porosity formation 216.

As discussed herein, in some embodiments, the brine may be pumped into the formation. In some embodiments, the man-made impermeable barriers 226 may be placed before any injected fluid has been injected into the formation 200.

Once the man-made impermeable barriers 226 are formed, the wellbore 220 and the horizontal wellbores 221 may be filled in and operation of the injection facility 204 and the collection facility 208 may begin. Optionally, to prevent the wellbore 220 and the horizontal wellbores 221 from acting as undesirable flow paths to the brine, the wellbore 220 and the horizontal wellbores 221 may also be filled with barrier material 224, or they may be cased and used as observation wells (as described above).

FIG. 2-2 is schematic diagram of a side view illustrating the flow paths of a brine 110 flowing between two wellbores (described herein as an injection well and a production well 106). As shown, the man-made impermeable barriers 226 direct a portion of brine 210 to follow a tortuous flow path 230 up and over the high porosity formation 216 toward the production zone 207 of the production well 206. The tortuous flow path 230 also allows portions of the brine 210 to flow down through different segments of the high porosity formation 216 to join a flow path 212 under the man-made impermeable barriers 226 that also flows toward the production zone 207 of the production well 206.

As the brine 210 follows the tortuous flow path 230, the brine 210 may change flow direction at an angle 232. The angle 232 may range from 5 degrees to as much as 180 degrees. In some applications, the angle 232 may be greater than 5 degrees. In other applications, the angle 232 may be greater than 10 degrees. While in others, the angle 232 may be greater than 15 degrees or greater than 20 degrees.

Generally, the angle 232 may range from 5 degrees to as much as 180 degrees. In some applications, the angle 232 may range from 10 degrees to 160 degrees. In some applications, the angle 232 may range from 15 degrees to 145 degrees. In some applications, the angle 232 may range from 20 degrees to 135 degrees. In some applications, the angle 232 may range from 15 degrees to 90 degrees. In other applications, the angle 232 may range from 15 degrees to 75 degrees. In some applications, the angle 232 may be greater than 5 degrees but less than 90 degrees.

Because of the tortuous flow path 230, the brine 210 may be extended to flow across a wide area of the formation 200 and high porosity formation 216.

FIG. 3-1 is schematic diagram of a top view of an injection zone 303 of an injection well 302 injecting brine 310 into formation 300. While three distinct flow paths 312 are shown flowing through the formation 300, the brine 310 may follow a plethora of flow paths 312 through formation 300. Ideally, the brine 310 would move throughout all of the formation 300. However, when the flow paths 312 encounter a high porosity formation 316, the flow paths 312 may converge into undesirable flow paths 318. The undesirable flow paths 318 represent the paths of least resistance to the production zone 307 of a production well 306. Collectively, the flow paths 312 and undesirable flow paths 318 are the previously existing flow paths 319 that will be altered by the construction of man-made impermeable barriers 326 as shown in FIG. 3-2.

FIG. 3-2 is schematic diagram of a top view of wellbores 320 used to form man-made impermeable barriers 326 between the injection well 302 and the production well 306. For clarity the brine 310 and flow paths are not shown. Two wellbores 320 extend into the formation 300 and one wellbore 320 extends into the high porosity formation 316.

Fractures 322 are created by hydraulically fracturing the formation 100 and the high porosity formation 316 from the wellbores 320. Barrier material 324 is inserted into the fractures 322. As the hydraulic pressure is released, the fractures 322 close around the barrier material 324 to form the man-made impermeable barriers 326. As shown, the man-made impermeable barriers 326 are vertically oriented because of the stresses in the formation 100 and the high porosity formation 316.

The man-made impermeable barriers 326 extend away from the wellbores 320 and may extend from the wellbore 320 at different angles 340 relative to an axis line extending between the injection well 302 and the production well 306. The angles 340 may range from 0 to 90 to the axis line 342. The man-made impermeable barriers 326 may extend at different angles 340 as necessary to alter the flow paths of injected fluid through the formation 100 and the high porosity formation 316. In some applications, the angles 340 may be greater than 5 degrees. In other applications, the angles 340 may be greater than 10 degrees. While in others, the angles 340 may be greater than 15 degrees or greater than 20 degrees.

In some applications, the angles 340 may range from 15 degrees to 90 degrees. In other applications, the angle may range from 15 degrees to 75 degrees. In some applications, the angles 340 may be greater than 5 degrees but less than 90 degrees.

FIG. 3-3 is a schematic diagram of a top view of an injection well 302 injecting brine 310 into formation 100. The wellbore closest to the injection well 302 has been filled in and allows brine 310 to pass through the area where that wellbore was. The wellbore 320 was second from the injection well 302 in FIG. 3-2 and has been filled in with barrier material 324 to become part of the man-made impermeable barrier 326. The man-made impermeable barrier 326 of the wellbore 320 works with its abutting man-made impermeable barriers 326 to direct the tortuous flow path 330 away from the high porosity formation 316.

The last wellbore (shown in FIG. 3-2) that was closest to the production well 306 is also shown as filled in and allows the tortuous flow path 330 to pass between the man-made impermeable barriers 326 closest to the production well 306. In this application, the tortuous flow path 330 allows the brine 310 to follow a flow path longer than the previously existing flow path shown in FIG. 3-1 and cover a broader area of the formation 300 and high porosity formation 316.

It should also be noted that the tortuous flow path 330 moves through a range of angles 332 and is much longer than the undesirable flow paths 318 of FIG. 3-1. As a consequence, the brine contacts or passes through more of the formation 300 and high porosity formation 316 than the undesirable flow paths 318 of FIG. 3-1 because of the positioning of the man-made impermeable barriers 326.

The angles 332 may range from 5 degrees to as much as 180 degrees. In some applications, the angles 332 may be greater than 5 degrees. In other applications, the angles 332 may be greater than 10 degrees. While in others, the angles 332 may be greater than 15 degrees or greater than 20 degrees.

Generally, the angles 332 may range from 5 degrees to as much as 180 degrees. In some applications, the angles 332 may range from 10 degrees to 160 degrees. In some applications, the angles 332 may range from 15 degrees to 145 degrees. In some applications, the angles 332 may range from 20 degrees to 135 degrees. In some applications, the angles 332 may range from 15 degrees to 90 degrees. In other applications, the angles 332 may range from 15 degrees to 75 degrees. In some applications, the angles 332 may be greater than 5 degrees but less than 90 degrees.

Figure 4:
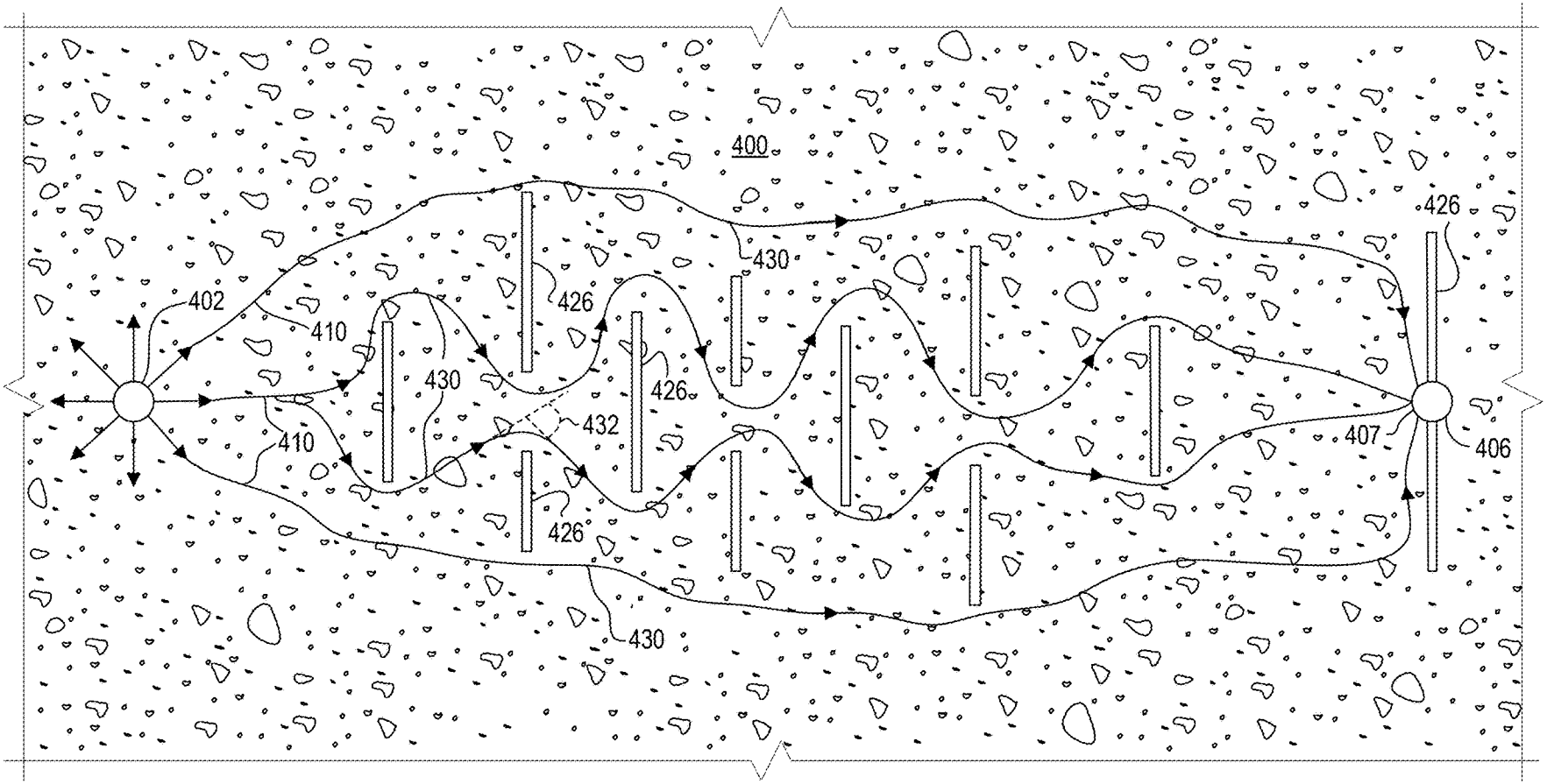
FIG. 4 is a schematic diagram of a top view of an injection well injecting fluid that interacts with the man-made impermeable barriers and is produced by a production well, according to at least one embodiment of the present disclosure.

FIG. 4 is schematic diagram of a top view of another application of a tortuous flow path 430 in a formation 400 according to at least one embodiment of the present disclosure. As shown, a plurality of man-made impermeable barriers 426 have been constructed and positioned within the formation 400. In some embodiments, a production well 406 may collect brine 410 as it passes through the formation. In some embodiments, brine 410 is injected into the formation 400 at the injection well 402 and travels through the formation 400 to the production well 406.

The production well 406 is shown as having man-made impermeable barriers 426 extending from the production well 406. The man-made impermeable barriers 426 extending from the production well 406 may be disposed to direct the brine 410 toward a production zone 407 of the production well 406.

The brine 410 flows through the formation 400 along a tortuous flow paths 430 around the man-made impermeable barriers 426. The man-made impermeable barriers 426 assist in directing and altering the flow of brine 410 through a long flow path and wider area of the formation 400 than would otherwise be possible because fluid will follow the path of least resistance through a formation 400, resulting in greater volumes of brine 410 rich in the desired substance collected at the production well 406. In some embodiments, the dissolving of desired minerals within the formation 400 is enhanced because the brine can interact with more of the formation 400 and may have more time to work within the formation 400.

Additionally, as the tortuous flow paths 430 are able to direct the brine to change directions at angles 432, the injected fluid may slow its flow through the formation 400. As shown the angles 432 may range from a few degrees to close to 180 degrees. As shown, the brine may change its direction about 90 degrees. At slower speeds, more of the desired mineral may be concentrated within the brine 410 and thus, increase the sweep efficiency of the production well 406. At other points within the tortuous flow path 430, brine 410 may follow a relatively straight paths past the impermeable barriers 426.

The angles 432 may range from 5 degrees to as much as 180 degrees. In some applications, the angles 432 may be greater than 5 degrees. In other applications, the angles 432 may be greater than 10 degrees. While in others, the angles 432 may be greater than 15 degrees or greater than 20 degrees.

Generally, the angles 432 may range from 5 degrees to as much as 180 degrees. In some applications, the angles 432 may range from 10 degrees to 160 degrees. In some applications, the angles 432 may range from 15 degrees to 145 degrees. In some applications, the angles 432 may range from 20 degrees to 135 degrees. In some applications, the angles 432 may range from 15 degrees to 90 degrees. In other applications, the angles 432 may range from 15 degrees to 75 degrees. In some applications, the angles 432 may be greater than 5 degrees but less than 90 degrees.

Figure 5:
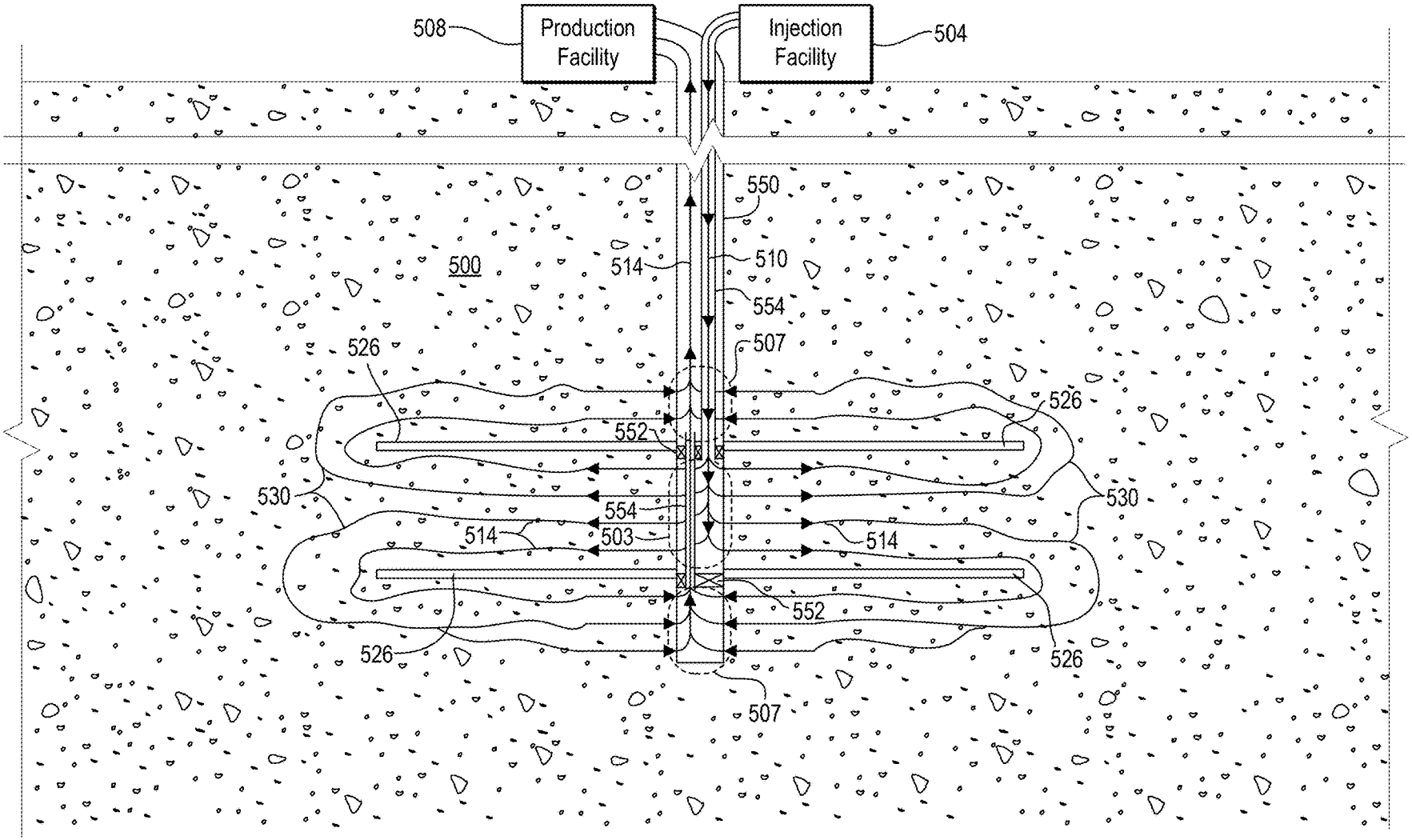
FIG. 5 is a schematic diagram of a side view of a single well including an injection zone from which fluid is injected underground that interacts with man-made impermeable barriers and is produced at production zones of the well, according to at least one embodiment of the present disclosure.

FIG. 5 is schematic diagram of a side view of a single well 550 including an injection zone 503 from which fluid 510 is injected in a formation 500. As shown, the well 550 is connected to an injection facility 504 by an injection pipe 554 that extends down the well 550. As the fluid 510 enters the formation 500, the fluid 510 begins dissolving desired mineral salts and moves toward the production zones 507 becoming injected fluid 514.

The man-made impermeable barriers 526 extend horizontally from the well 550 into the formation 500. The injected fluid 514 follows tortuous flow paths 530 around man-made impermeable barriers 526 making a flow direction change of about 180 degrees toward the production zones 507 on the single well 550. As shown, the man-made impermeable barriers 526 may be used to direct the flow of injected fluid away from the well 550 and toward desirable parts of the formation 500. The formation 500 may comprise multiple different geological regions with different porosities and properties that surround the well 550.

When reaching the bottom production zone 507, the injected fluid is pulled into the well 550 and pumped through a connection pipe 554 to the second production zone 507 where the injected fluid 514 is aggregated and moved up the well 550 to the collection facility 508. The injection zone 503 and the production zones 507 are separated by seals 552 that allow for different pressures that may be applied to the different injection zone 503 and the production zones 507 of the well 550.

In other configurations not shown, the well 550 may have only a single injection zone 503, the production zone 507, and a single man-made impermeable barrier 526 separating the injection zone 503 from the production zone 507. Alternatively, the well 550 may have a plurality of injection zones 503, production zones 507, and man-made impermeable barriers 526, with each injection zone 503 separated from an adjacent production zone 507 by a man-made impermeable barrier 526.

The well 550 may be used to minimize the total number wells that may be needs to harvest desired minerals or substances from an area, because the man-made impermeable barriers 526 may be used to extend the reach of each well as well as protecting a well against some risk from thief zones depending on where they are located as the man-made impermeable barriers 526 may prevent injected fluid 514 from reaching a thief zone.

Figure 6:
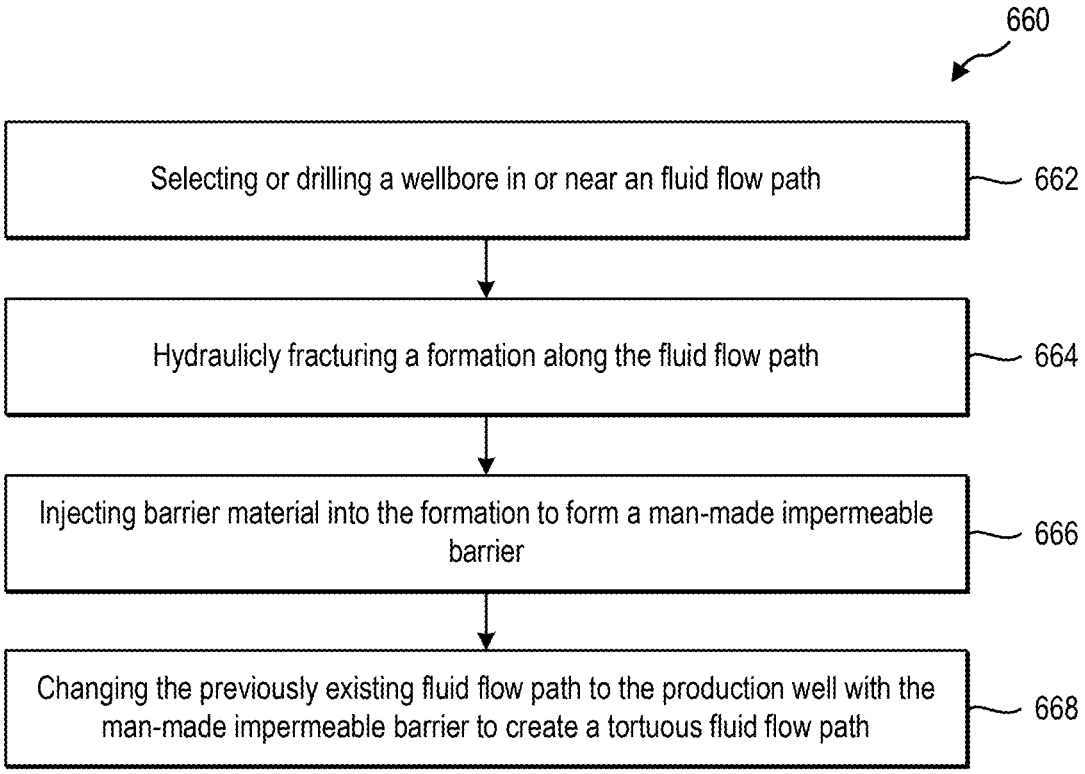
FIG. 6 is a flow chart illustrating a method according to at least one embodiment of the present disclosure.

FIG. 6 is a flow chart illustrating a method of creating a tortuous flow path to a production well at 660. A wellbore is selected in or near a previously existing fluid flow path at 662. Next, a formation is hydraulicly fractured along the previously existing fluid flow path at 664. Barrier material is injected into the formation to form a man-made impermeable barrier at 666. Lastly, the previously existing fluid flow path to the production well is changed by the man-made impermeable barrier to create the tortuous flow path at 668.

In some applications, the man-made impermeable barrier may be a first man-made impermeable barrier. A second fracture may be created and barrier material may be injected into the second fracture to form a second man-made impermeable barrier. The second man-made impermeable barrier may be disposed to add a second alteration to the previously existing fluid flow path.

A third fracture may be hydraulicly formed. Barrier material may be injected into the third fracture to form a third man-made impermeable barrier, wherein the third man-made impermeable barrier adds a third alteration to the tortuous flow path to the production well. The tortuous flow path may make at least a 5 degree flow direction change in the tortuous flow path at each of the first man-made impermeable barrier, the second man-made impermeable barrier, and the third man-made impermeable barrier.

The method may also include identifying the previously existing fluid flow path to the production well and estimating stresses within formations proximate the previously existing fluid flow path. Further, an alteration plan may be engineered to change the previously existing fluid flow path into the tortuous flow path based on the identified previously existing fluid flow path to the production well and the estimated stresses within the formations proximate the previously existing fluid flow path. The method may also include the step of whether the tortuous flow path to the production well is within a tolerance of the alteration plan is detected.

These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or collection process, and may include values that are within 5%, within 1%, within 0.1%, or within 0.01% of a stated value.

INDUSTRIAL APPLICABILITY

In general, a system may be used to create a tortuous flow path. The system may include a production well and an injection well remotely spaced from the production well. A previously existing fluid flow path may extend between the injection well and the production well. A wellbore may be positioned in or near the previously existing fluid flow path so that a man-made impermeable barrier may be made and disposed in the previously existing fluid flow path. The wellbore may be used to hydraulically fracture a formation and allow barrier material to be injected into the fracture. Once the hydraulic pressure is released, the fracture will close around the barrier material and create the man-made impermeable barrier.

The man-made impermeable barrier once created will change, alter, or divert the previously existing fluid flow path so that it becomes a tortuous flow path between the injection well and the production well. This man-made impermeable barrier may be accompanied by the creation of other man-made impermeable barriers. For clarity, this man-made impermeable barrier may be referred to as a first man-made impermeable barrier. A second man-made impermeable barrier and a third man-made impermeable barrier may be disposed so that the tortuous flow path is affected by each of the first man-made impermeable barrier, the second man-made impermeable barrier, and the third man-made impermeable barrier. In some applications, the first man-made impermeable barrier, the second man-made impermeable barrier, and the third man-made impermeable barrier are separated from each other. As the tortuous flow path interacts with the impermeable barriers, the tortuous flow path may make at least a 2 degrees change in flow direction at each of the first man-made impermeable barrier, the second man-made impermeable barrier, and the third man-made impermeable barrier. The man-made impermeable barriers maybe disposed at different angles and spacing relative to each other. In some applications, the man-made impermeable barriers may be horizontally or vertically disposed in the formation. In others, a mixture of horizontal and vertical man-made impermeable barriers may be found. While in others, the man-made impermeable barrier may be disposed at angles.

The man-made impermeable barriers may be created and extend from injection wells, production wells, monitoring or testing wells, and may be created and extend from wellbores created solely for the purpose of creating man-made impermeable barriers. The man-made impermeable barriers may be planned and engineered based on knowledge of the stresses in a formation before any wells are drilled in a formation or before collection begins at a formation. Alternatively, the man-made impermeable barriers may be installed at current collection formations as a remedial measure when a fall in sweep efficiency is detected.

When installed, the tortuous flow path may make a greater than 2 degree change in the tortuous flow path at each of the first man-made impermeable barrier, the second man-made impermeable barrier, and the third man-made impermeable barrier. In some cases, the tortuous flow path may make a greater than 5 degree change in the tortuous flow path at each of the first man-made impermeable barrier, the second man-made impermeable barrier, and the third man-made impermeable barrier. Alternatively, the tortuous flow path may make a greater than 5 degrees change in the tortuous flow path at the first man-made impermeable barrier and a greater than a 15 degrees change in the tortuous flow path at each of the second man-made impermeable barrier and the third man-made impermeable barrier.

The man-made impermeable barrier comprises at least one of a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, and a thermoset plastic. The fluid may include water, brine, or other mixture created for the purpose of dissolving specific minerals in the formation.

An advantage of the tortuous flow path is that it may be longer than a previously existing fluid flow path and may cover a larger volume of a formation than the previously existing fluid flow path. This may be accomplished because the man-made impermeable barrier may be disposed so that the tortuous flow path is diverted through a part of a formation that was not a part of the previously existing fluid flow path. As a consequence of using a tortuous flow path for the injected fluid, more of a formation may be covered by the injected fluid to dissolve a desired mineral from the formation that can be produced at the production well and/or a breakthrough of the injected fluid into the production zone may be delayed, and efficiency of the extraction is enhanced.

A method of creating a tortuous flow path to a production well includes selecting or drilling a wellbore in or near a previously existing fluid flow path. A next step may be hydraulicly fracturing a formation along the previously existing fluid flow path and injecting barrier material into the formation to form a man-made impermeable barrier. Lastly, the method may include changing the previously existing fluid flow path to the production well with the man-made impermeable barrier to create the tortuous flow path.

The method may further include creating a second fracture and injecting barrier material into the second fracture to form a second man-made impermeable barrier so that the second man-made impermeable barrier adds a second alteration to the previously existing fluid flow path. Similarly, a third fracture may be hydraulically created and injected with barrier material to form a third man-made impermeable barrier. The third man-made impermeable barrier may add a third alteration to the tortuous flow path. In one application, the tortuous flow path makes at least a 5 degree flow direction change in the tortuous flow path at each of the first man-made impermeable barrier, the second man-made impermeable barrier, and the third man-made impermeable barrier.

Prior to creating the man-made impermeable barriers, the method may include identifying the previously existing fluid flow path to the production well and estimating stresses within formations proximate the previously existing fluid flow path. Further, conducting seismic and/or magnetic resonance imaging maybe conducted on the formation to determine density throughout the formation, estimate stresses within the formation, and/or identify flow paths within the formation. Once identified and estimated, the method may include engineering an alteration plan to change the previously existing fluid flow path into the tortuous flow path based on the identified previously existing fluid flow path to the production well and the estimated stresses within the formations proximate the previously existing fluid flow path.

The method may also include detecting whether the tortuous flow path to the production well is within a tolerance of the alteration plan. If not, remedial actions may be taken including creating additional man-made impermeable barriers to further change the tortuous flow paths. In some cases, vertical and horizontal wellbores may be drilled and filled with barrier material in locations where the stresses in the formation prevent the right shape of man-made impermeable barrier to be formed.

The method may also include the steps of forming the man-made impermeable barriers at different angles and orientations to each other and the injection well and the production well. Further, the man-made impermeable barriers may be created at the injection well and/or the production well in order to create the tortuous flow path.

The method may also include the step of filing in the wellbore with a material whose porosity is similar to the targeted formation. Alternatively, the method may include the step of filing in the wellbore with barrier material so that the wellbore becomes a man-made impermeable barrier. Alternatively the method may include instrumenting the wellbore as an observation well.

A system implementing a tortuous flow path may include a wellbore comprising at least one of a injection zone and a production zone, and a man-made impermeable barrier extending from the wellbore adjacent the at least one of the injection zone and the production zone, wherein a fluid follows the tortuous flow path and makes at least a 5 degree change in flow direction proximate the man-made impermeable barrier. The man-made impermeable barrier may be constructed by hydraulicly fracturing a formation proximate the wellbore and injecting barrier material into the formation to form the man-made impermeable barrier.

The system further include a second man-made impermeable barrier and a third man-made impermeable barrier. The tortuous flow path may be altered by each of the first man-made impermeable barrier, the second man-made impermeable barrier, and the third man-made impermeable barrier. In some cases, the first man-made impermeable barrier, the second man-made impermeable barrier, and the third man-made impermeable barrier are separated from each other. Further, the tortuous flow path may make at least a 5 degree change in flow direction at each of the second man-made impermeable barrier and the third man-made impermeable barrier.

Alternatively, plurality of injection wells and/or a plurality of production wells may be used to access and produce desired minerals and substances from a formation. Desired minerals and substances may include lithium, magnesium, boron, bromine, manganese, vanadium, or any other soluble minerals, and substances, such as oil, natural gas, coalbed methane, shale oil, pyrolysis oil, pyrolysis gas, a pyrolysis product of coal, and other hydrocarbons that are in a gaseous or liquid state.

The fluid may be water or solutions of water with other species. The water may be a "brine" that includes dissolved inorganic salts of chloride, sulfates and carbonates of Group I and II elements of The Periodic Table of Elements. Organic salts may also be in the fluid. The water may also include acids and bases to alter the pH of the fluid.

The barrier material may include a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, a thermoset plastic, or a mixture of different materials. Barrier material may be added to the hydraulic fluid as it is used to create a fracture in a formation. Then as the hydraulic pressure is released, the fracture closes around the barrier material to form a man-made impermeable barrier.

The man-made impermeable barriers may be positioned to change, alter, or divert fluid through a tortuous flow path such that the flow direction is changed by an angle of greater than 2 degrees. Alternatively, the angle may be greater than 3 degrees. In some applications, the angle may be greater than 5 degrees. In other applications, the angle may be greater than 10 degrees. While in others, the angle may be greater than 15 degrees or greater than 20 degrees.

Generally, the angle may range from 5 degrees to as much as 180 degrees. In some applications, the angle may range from 10 degrees to 160 degrees. In some applications, the angle may range from 15 degrees to 145 degrees. In some applications, the angle may range from 20 degrees to 135 degrees. In some applications, the angle may range from 15 degrees to 90 degrees. In other applications, the angle may range from 15 degrees to 75 degrees. In some applications, the angle may be greater than 5 degrees but less than 90 degrees.

The tortuous flow paths follow new flow paths through the formation allowing the injected fluid to dissolve the desired mineral from additional areas of the formation that may have been previously untouched before the creation of the man-made impermeable barriers and/or to delay the breakthrough of the injected brine into the production zone. In other words, the tortuous flow path may divert through a part of the formation that was not a part of a previously existing fluid flow path.

In some applications, the man-made impermeable barriers may be placed before any injected fluid has moved into the formation. The placement of the man-made impermeable barriers may be based on seismic, magnetic resonance imaging, and other data gathering methods about the formation. The placement of the man-made impermeable barriers may also be based on the experience of the well diggers. For example, the wellbore may be a test well in which a high porosity formation is discovered. To determine the boundaries of the high porosity formation, horizontal wellbores may be drilled. Consequently, this information about the formation and the high porosity formation may allow an a tortuous flow path to be designed and created to alter potential flow paths of injected fluid through the formation based on the estimated stresses within the formation, the geology of the formation, and the potential flow paths of the injected fluid through formation.

The tortuous flow path may follow a flow direction that is at a different angle when compared to the previously existing fluid flow path. In other words, the tortuous flow path diverges from the previously existing fluid flow path at an angle greater than 3 degrees. The angle may range from 5 degrees to as much as 180 degrees. In some applications, the angle may be greater than 5 degrees. In other applications, the angle may be greater than 10 degrees. While in others, the angle may be greater than 15 degrees or greater than 20 degrees.

Generally, the angle may range from 5 degrees to 160 degrees. In some applications, the angle may range from 15 degrees to 145 degrees. In some applications, the angle may range from 20 degrees to 135 degrees. In some applications, the angle may range from 3 degrees to 90 degrees. In other applications, the angle may range from 15 degrees to 75 degrees.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

EXAMPLE ASPECTS

Aspect A1: A system for creating a tortuous flow path, the system comprising: a production well; an injection well remotely spaced from the production well; and a man-made impermeable barrier disposed between the injection well and the production well to create tortuous flow path for a fluid flowing between the injection well and the production well.

Aspect A2: The system of aspect A1, wherein the man-made impermeable barrier is a first man-made impermeable barrier, the system further comprising a second man-made impermeable barrier and a third man-made impermeable barrier, wherein the tortuous flow path is affected by each of the first man-made impermeable barrier, the second man-made impermeable barrier, and the third man-made impermeable barrier.

Aspect A3: The system of aspect A1 or A2, wherein the first man-made impermeable barrier, the second man-made impermeable barrier, and the third man-made impermeable barrier are separated from each other, wherein the tortuous flow path makes at least a 2 degree change in flow direction at each of the first man-made impermeable barrier, the second man-made impermeable barrier, and the third man-made impermeable barrier.

Aspect A4: The system of aspect A1, A2, or A3, wherein the tortuous flow path makes a greater than 5 degree direction change proximate the first man-made impermeable barrier and a greater than a 15 degree direction change proximate each of the second man-made impermeable barrier and the third man-made impermeable barrier.

Aspect A5: The system of aspect A1, A2, A3, or A4, wherein the man-made impermeable barrier comprises at least one of a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, and a thermoset plastic.

Aspect A6: The system of aspect A1, A2, A3, A4, or A5, further comprising a previously existing fluid flow path extending between the injection well and the production well, wherein the man-made impermeable barrier is disposed in the previously existing fluid flow path to create the tortuous flow path.

Aspect A7: The system of aspect A1, A2, A3, A4, A5, or A6, wherein the tortuous flow path covers a larger volume than the previously existing fluid flow path.

Aspect A8: The system of aspect A1, A2, A3, A4, A5, A6, or A7, wherein the man-made impermeable barrier is disposed so that the tortuous flow path is diverted through a part of a formation that was not a part of the previously existing fluid flow path.

Aspect A9: The system of aspect A1, A2, A3, A4, A5, A6, A7, or A8, further comprising a wellbore disposed between the injection well and the production well, wherein the man-made impermeable barrier is constructed by hydraulicly fracturing a formation proximate the wellbore and injecting barrier material into the fracture to form the man-made impermeable barrier.

Aspect A10: The system of aspects A1, A2, A3, A4, A5, A6, A7, A8, or A9, further comprising a facility, wherein the fluid is collected at the production zone and transported to the facility, wherein the fluid contains a desired element, wherein the facility extracts the desired element from the fluid.

Aspect A11: The system of aspect A10, wherein the facility extracts the desired element from the fluid, the facility produces a concentrated fluid having an increased concentration of the desired element and a depleted fluid having a reduced concentration of the desired element.

Aspect A12: The system of aspect A11, wherein the depleted fluid is injected into the injection zone.

Aspect A13: The system of aspect A10, wherein the desired element is lithium, manganese, copper, cobalt, nickel, or vanadium.

Aspect B1: A method of creating a tortuous flow path from an injection zone to a production zone, the method comprising: hydraulicly fracturing a formation along the previously existing fluid flow path; injecting barrier material into the formation to form a man-made impermeable barrier; and changing the previously existing fluid flow path to the production zone with the man-made impermeable barrier to create the tortuous flow path.

Aspect B2: The method of aspect B1, wherein the man-made impermeable barrier is a first man-made impermeable barrier, the method further comprising creating a second fracture; and injecting barrier material into the second fracture to form a second man-made impermeable barrier, wherein the second man-made impermeable barrier adds a second alteration to the previously existing fluid flow path.

Aspect B3: The method of aspect B1 or B2, the method further comprising creating a third fracture; and injecting barrier material into the third fracture to form a third man-made impermeable barrier, wherein the third man-made impermeable barrier adds a third alteration to the tortuous flow path to the production well, wherein the tortuous flow path makes at least a 5 degree flow direction change in the tortuous flow path at each of the first man-made impermeable barrier, the second man-made impermeable barrier, and the third man-made impermeable barrier.

Aspect B4: The method of aspect B1, B2, or B3, further comprising identifying the previously existing fluid flow path to the production well and estimating stresses within formations proximate the previously existing fluid flow path.

Aspect B5: The method of aspect B1, B2, B3, or B4, further comprising engineering an alteration plan to change the previously existing fluid flow path into the tortuous flow path based on the identified previously existing fluid flow path to the production well and the estimated stresses within the formations proximate the previously existing fluid flow path.

Aspect B6: The method of aspect B1, B2, B3, B4, or B5, further comprising detecting whether the tortuous flow path to the production well is within a tolerance of the alteration plan.

Aspect B7: The method of aspect B1, B2, B3, B4, B5, or B6, wherein the first man-made impermeable barrier, the second man-made impermeable barrier, and the third man-made impermeable barrier are separated from each other, wherein the tortuous flow path makes at least a 2 degree change in flow direction at each of the first man-made impermeable barrier, the second man-made impermeable barrier, and the third man-made impermeable barrier.

Aspect B8: The method of aspect B1, B2, B3, B4, B5, B6, or B7, wherein the tortuous flow path makes a greater than 5 degree direction change proximate the first man-made impermeable barrier and a greater than a 15 degree direction change proximate each of the second man-made impermeable barrier and the third man-made impermeable barrier.

Aspect B9: The method of aspect B1, B2, B3, B4, B5, B6, B7, or B8, wherein the man-made impermeable barrier comprises at least one of a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, and a thermoset plastic.

Aspect B10: The method of aspect B1, B2, B3, B4, B5, B6, B7, B8, or B9, further comprising a previously existing fluid flow path extending between the injection well and the production well, wherein the man-made impermeable barrier is disposed in the previously existing fluid flow path to create the tortuous flow path.

Aspect B11: The method of aspect B1, B2, B3, B4, B5, B6, B7, B8, B9, or B10, wherein the tortuous flow path covers a larger volume than the previously existing fluid flow path.

Aspect B12: The method of aspect B1, B2, B3, B4, B5, B6, B7, B8, B9, B10, or B11, wherein the man-made impermeable barrier is disposed so that the tortuous flow path is diverted through a part of a formation that was not a part of the previously existing fluid flow path.

Aspect B13: The method of aspect B1, B2, B3, B4, B5, B6, B7, B8, B9, B10, B11 or B12, wherein the injection zone is in an injection well and the production zone is in a production well spaced apart from the injection zone, wherein the method further includes selecting or drilling a wellbore in or near the previously existing fluid flow paths and hydraulicly fracturing and injecting the barrier material using the selected or drilled wellbore.

Aspect B14: The method of aspect B1, B2, B3, B4, B5, B6, B7, B8, B9, B10, B11 or B12, wherein the injection zone and the production zone are located in the same wellbore.

Aspect C1: A system implementing a tortuous flow path comprising: a wellbore comprising at least one of an injection zone and a production zone; and a man-made impermeable barrier extending from the wellbore adjacent the at least one of the injection zone and the production zone, wherein a fluid follows the tortuous flow path and makes at least a 5 degree change in flow direction proximate the man-made impermeable barrier.

Aspect C2: The system of aspect C1, wherein the man-made impermeable barrier is constructed by hydraulicly fracturing a formation proximate the wellbore and injecting barrier material into the formation to form the man-made impermeable barrier.

Aspect C3: The system of aspect C1 or C2, wherein the barrier material comprises at least one of a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, and a thermoset plastic.

Aspect C4: The system of aspect C1, C2, or C3, wherein the man-made impermeable barrier is a first man-made impermeable barrier, the system further comprising a second man-made impermeable barrier and a third man-made impermeable barrier, wherein the tortuous flow path is altered by each of the first man-made impermeable barrier, the second man-made impermeable barrier, and the third man-made impermeable barrier.

Aspect C5: The system of aspect C1, C2, C3, or C4, wherein the first man-made impermeable barrier, the second man-made impermeable barrier, and the third man-made impermeable barrier are separated from each other, wherein the tortuous flow path makes at least a 5 degrees change in flow direction at each of the second man-made impermeable barrier and the third man-made impermeable barrier.

Aspect D1: The system for creating a tortuous flow path, the system comprising: a production zone; an injection zone remotely spaced from the production zone; and a man-made impermeable barrier disposed between the injection zone and the production zone to create tortuous flow path for a fluid flowing between the injection zone and the production zone.

Aspect D2: The system of aspect D1, wherein the man-made impermeable barrier is a first man-made impermeable barrier, the system further comprising a second man-made impermeable barrier and a third man-made impermeable barrier, wherein the tortuous flow path is affected by each of the first man-made impermeable barrier, the second man-made impermeable barrier, and the third man-made impermeable barrier.

Aspect D3: The system of aspect D1 or D2, wherein the first man-made impermeable barrier, the second man-made impermeable barrier, and the third man-made impermeable barrier are separated from each other, wherein the tortuous flow path makes at least a 2 degree change in flow direction at each of the first man-made impermeable barrier, the second man-made impermeable barrier, and the third man-made impermeable barrier.

Aspect D4: The system of aspect D1, D2, or D3, wherein the tortuous flow path makes a greater than 5 degree direction change proximate the first man-made impermeable barrier and a greater than a 15 degree direction change proximate each of the second man-made impermeable barrier and the third man-made impermeable barrier.

Aspect D5: The system of aspect D1, D2, D3, or D4, wherein the man-made impermeable barrier comprises at least one of a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, and a thermoset plastic.

Aspect D6: The system of aspect D1, D2, D3, D4, or D5, further comprising a previously existing fluid flow path extending between the injection zone and the production zone, wherein the man-made impermeable barrier is disposed in the previously existing fluid flow path to create the tortuous flow path.

Aspect D7: The system of aspect D1, D2, D3, D4, D5, or D6, wherein the tortuous flow path covers a larger volume than the previously existing fluid flow path.

Aspect D8: The system of aspect D6 or D7, wherein the man-made impermeable barrier is disposed so that the tortuous flow path is diverted through a part of a formation that was not a part of the previously existing fluid flow path.

Aspect D9: The system of aspect D1, D2, D3, D4, D5, D6, D7, or D8, wherein the injection zone is part of an injection well and the production zone is part of production well, the system further comprising a wellbore disposed between the injection well and the production well, wherein the man-made impermeable barrier is constructed by hydraulicly fracturing a formation proximate the wellbore and injecting barrier material into the fracture to form the man-made impermeable barrier.

Aspect D10: The system of aspect D1, D2, D3, D4, D5, D6, D7, D8, or D9, wherein the tortuous flow path makes at least a 5 degree flow direction change in the tortuous flow path at each of the first man-made impermeable barrier, the second man-made impermeable barrier, and the third man-made impermeable barrier.

Aspect D11: The system of aspect D1, D2, D3, D4, D5, D6, D7, D8, D9, or D10, wherein a portion of the tortuous flow path is longer than the previously existing fluid flow path.

Aspect D12: The system of aspect D1, D2, D3, D4, D5, D6, D7, D8, D9, D10, or D11, wherein the tortuous flow path diverges from the previously existing fluid flow path at an angle greater than 3 degrees.

Aspect D13: The system of aspect D1, D2, D3, D4, D5, D6, D7, D8, D9, D10, D11, or D12, wherein the man-made impermeable barrier is vertically oriented.

Aspect D14: The system of aspect D1, D2, D3, D4, D5, D6, D7, D8, D9, D10, D11, or D12, wherein the man-made impermeable barrier is horizontally oriented.

Aspect D15: The system of aspect D1, D2, D3, D4, D5, D6, D7, D8, D9, D10, D11, D12, D13, or D14, wherein the fluid is selected to dissolve a desired mineral from the formation.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The present disclosure also contemplates that one or more aspects of the embodiments described herein may be substituted in for one or more of the other aspects described. The scope of the disclosure is determined by the claims that follow.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for creating a tortuous flow path, the system comprising:

a production zone including a production well;

an injection zone including an injection well, the injection zone remotely spaced from the production zone;

at least one intermediate wellbore positioned outside of the production zone and the injection zone, the intermediate wellbore being initially open to permit injection of barrier material, the intermediate wellbore being subsequently blocked to prevent flow of production fluid through the intermediate wellbore; and a plurality of man-made impermeable barriers disposed between the injection zone and the production zone, the plurality of man-made impermeable barriers positioned in a high porosity region and a low porosity region and configured to divert fluid away from the high porosity region and through the low porosity region, thereby causing fluid to divert from a previously existing flow path and to flow along a tortuous flow path between the injection zone and the production zone, the plurality of man-made impermeable barriers comprising a first man-made impermeable barrier positioned adjacent a first well bore and a second man-made impermeable barrier positioned adjacent a second well bore, the second man-made impermeable barrier positioned downstream from the first man-made impermeable barrier relative to the tortuous flow path, the second man-made impermeable barrier being spaced apart from the first man-made impermeable barrier relative to an axis line extending from the injection well to the production well, the second man-made impermeable barrier offset from the first man-made impermeable barrier in a transverse direction such that the second man-made impermeable barrier is misaligned with and partially overlapping the first man-made impermeable barrier as viewed along the axis line.

2. The system of claim 1, wherein the first man-made impermeable barrier and the second man-made impermeable barrier are separated from each other, and wherein the tortuous flow path makes at least a 2 degree change in flow direction from the previously existing fluid flow path at each of the first man-made impermeable barrier and the second man-made impermeable barrier.

3. The system of claim 2, wherein the tortuous flow path makes a greater than 5 degree direction change from the previously existing fluid flow path proximate the first man-made impermeable barrier and a greater than a 15 degree direction change from the previously existing fluid flow path proximate the second man-made impermeable barrier.

4. The system of claim 1, wherein each of the plurality of man-made impermeable barriers comprises at least one of a cement, silica grout, a clay, a bentonite, a polymeric superabsorbent, an epoxy, a curable resin, a waste agricultural product, a wood product, a precipitating salt, a calcium carbonate, a wax, a ground rubber, an asphalt, plastic beads, a thermoplastic, or a thermoset plastic.

5. The system of claim 1, wherein the first man-made impermeable barrier is disposed in the previously existing fluid flow path to create the tortuous flow path.

6. The system of claim 5, wherein the first man-made impermeable barrier is disposed so that the tortuous flow path is diverted through a part of a formation that was not a part of the previously existing fluid flow path.

7. The system of claim 1, further comprising a facility, wherein the fluid is collected at the production zone and transported to the facility, wherein the fluid contains a desired element, wherein the facility extracts the desired element from the fluid.

8. The system of claim 7, wherein the facility extracts the desired element from the fluid, the facility produces a concentrated fluid having an increased concentration of the desired element and a depleted fluid having a reduced concentration of the desired element.

9. The system of claim 8, wherein the depleted fluid is injected into the injection zone.

10. The system of claim 7, wherein the desired element is lithium.

11. The system of claim 1, wherein the second man-made impermeable barrier is positioned downstream from the first man-made impermeable barrier and wherein the second man-made impermeable barrier further modifies the tortuous flow path to be longer than an undesirable flow path.

12. A method of creating a tortuous flow path from an injection zone to a production zone, the method comprising:

installing a first open intermediate wellbore positioned outside of the production zone and the injection zone;

hydraulicly fracturing a formation along a previously existing fluid flow path, thereby creating a first fracture;

injecting barrier material into the first fracture to form a first man-made impermeable barrier adjacent a first well bore, the first man-made impermeable barrier positioned in a high porosity region and a low porosity region and configured to divert fluid away from the high porosity region and through the low porosity region;

filling the first intermediate wellbore with barrier material to prevent the flow of production fluid through the first intermediate wellbore during production;

installing a second intermediate wellbore positioned outside of the production zone and the injection zone;

hydraulicly fracturing the formation to create a second fracture;

injecting barrier material into the second fracture to form a second man-made impermeable barrier positioned adjacent a second well bore and downstream from the first man-made impermeable barrier, the first man-made impermeable barrier and the second man-made impermeable barrier forming a plurality of man-made impermeable barriers, the second man-made impermeable barrier configured to divert fluid away from a high porosity region and through a low porosity region, wherein the second man-made impermeable barrier being spaced apart from the first man-made impermeable barrier relative to an axis line extending from the injection well to the production well, the second man-made impermeable barrier offset from the first man-made impermeable barrier in a transverse direction such that the second man-made impermeable barrier is misaligned with and partially overlapping the first man-made impermeable barrier as viewed along the axis line;

filling the second intermediate wellbore with barrier material to prevent the flow of production fluid through the second intermediate wellbore during production; and changing the previously existing fluid flow path to the production zone with the first man-made impermeable barrier to create the tortuous flow path.

13. The method of claim 12, wherein the injection zone is in an injection well and the production zone is in a production well spaced apart from the injection zone, wherein the method further includes selecting or drilling a plurality of wellbores in or near the previously existing fluid flow path and hydraulicly fracturing and injecting the barrier material using the selected or drilled plurality of wellbores.

14. The method of claim 13, wherein the second man-made impermeable barrier adds an alteration to the tortuous flow path.

15. The method of claim 14, the method further comprising:

creating a third fracture; and injecting barrier material into the third fracture to form a third man-made impermeable barrier, wherein the third man-made impermeable barrier adds a further alteration to the tortuous flow path to the production well, wherein the tortuous flow path makes at least a 5 degree flow direction change from the previously existing fluid flow path at each of the first man-made impermeable barrier, the second man-made impermeable barrier, and the third man-made impermeable barrier.

16. The method of claim 13, further comprising identifying the previously existing fluid flow path to the production well and estimating stresses within formations proximate the previously existing fluid flow path.

17. The method of claim 12, wherein the injection zone and the production zone are located in the same wellbore.

18. The method of claim 12, further comprising:

collecting a fluid having one or more elements of interest at the production well;

processing the fluid to extract the one or more elements of interest to yield a rich fluid and a depleted fluid; and injecting the depleted fluid at the injection well.

* * * * *